US005932086A

United States Patent [19]

Kasaaian

[11] Patent Number: 5,932,086

[45] Date of Patent: Aug. 3, 1999

[54] PROCESS FOR MAKING MANGANESE

[75] Inventor: Arash M. Kasaaian, Belpre, Ohio

[73] Assignee: Elkem Metals Company, L.P.

[21] Appl. No.: 08/933,467

[22] Filed: Sep. 18, 1997

[51] Int. Cl.[6] ..... C25C 1/10; C25C 1/12; C25B 1/00

[52] U.S. Cl. ..... 205/573; 205/583; 205/585; 205/539; 205/540

[58] Field of Search ..... 205/539, 540, 205/573, 583, 585

[56] References Cited

U.S. PATENT DOCUMENTS 5,232,490 8/1993 Bender et al. ..... 75/733

FOREIGN PATENT DOCUMENTS 60-221323 11/1985 Japan .

*Primary Examiner*—Kathryn Gorgos
*Assistant Examiner*—Edna Wong
*Attorney, Agent, or Firm*—Bierman, Muserlian and Lucas

[57] ABSTRACT

Using the electrolytic process to make manganese metal, a source of manganomanganic oxide ($Mn_3O_4$) is used in the sulfuric acid leach solution in conjunction with a reducing agent to convert the manganomanganic oxide into manganese sulfate for treatment in the electrolytic cell. Sources of manganomanganic oxide include sintered manganese ore, manganese ore having less than 7% available oxygen such as Assoman Ore, and MOR fume. Reducing agents include sulfur dioxide, activated carbon, reducing sugars and molasses.

14 Claims, No Drawings

PROCESS FOR MAKING MANGANESE

BACKGROUND OF THE INVENTION

1. Field of the Invention

This invention relates to a process for making manganese, electrolytic manganese dioxide, and specifically, the electrolytic process for making manganese, electrolytic manganese dioxide and $MnO_2$ wherein a source of manganomanganic oxide ($Mn_3O_4$) is treated in a leach solution in the presence of a reducing agent to convert the manganomanganic oxide to manganese sulfate. The leach solution is then treated to conventional purification and electrowinning steps to recover the manganese.

2. Prior Art

The electrolytic process is used to make a high purity (99.5%) manganese metal. Conventionally, a source of manganese oxide (MnO) is leached with sulfuric acid at a pH of 3 to convert the manganese oxide to manganese sulfate ($MnSO_4$). The leach solution is water based and manganese sulfate is soluble in the leach solution.

Conventionally, the source of manganese oxide is either a manganese ore which has been roasted to reduce the higher oxides of manganese (e.g. $MnO_2$, $Mn_2O_3$ and $Mn_3O_4$) to manganese oxide (MnO); or a slag obtained from a high carbon ferromanganese smelting operation. The slag contains manganese oxide. In either case, the conventional starting material for the electrolytic process is manganese oxide (MnO).

The purification of the leach solution is conducted to remove the other metals as precipitates. The aqueous leach solution is then neutralized with ammonia to a pH of 6–7 to precipitate the iron and aluminum which are later removed by filtration. A sulfide, usually hydrogen sulfide gas, is also added to the leach solution to precipitate the heavy metals such as arsenic, copper, zinc, lead, cobalt and molybdenum as sulfides which are also conventionally removed by filtration. Ferrous sulfide or ammonium sulfide plus air is added to the leach to remove colloidal sulfur, colloidal metallic sulfides and organic matter. Again, it is conventional to use filtration to remove these colloidal and organic materials.

Finally, the leach solution is added to an electrolytic cell and manganese metal from the leach solution deposits on the cathode. A high purity (99.5%) manganese is recovered from the cathode in a conventional manner.

SUMMARY OF THE INVENTION

It has now been discovered that a source of manganomanganic oxide ($Mn_3O_4$) in conjunction with a reducing agent can be employed in the leach solution to convert manganomanganic oxide to manganese sulfate ($MnSO_4$) in the electrolytic process for making manganese metal.

It has also been discovered that good sources of manganomanganic oxide are sintered manganese ore, fumes from MOR operations and raw manganese ores with less than about 7% available oxygen. Sintering of the ore converts all of the lower oxides of manganese in the ore to manganomanganic oxide.

The present invention allows for the elimination of the roasting step of the ore. Additionally, sources of manganomanganic oxide such as sintered ores and MOR fumes are less expensive than roasted ore and thus provides a cost advantage to the user of the present invention.

Broadly, the present invention is an improvement to the electrolytic process for making manganese wherein a sulfuric acid leach solution is used to convert a source of manganese oxide to manganese sulfate, the improvement comprising replacing said source of manganese oxide with a source of manganomanganic oxide in the sulfuric acid leach solution, and adding a reducing agent to said leach solution in an amount effective to reduce the manganomanganic oxide to manganese oxide.

DETAILED DESCRIPTION OF THE INVENTION

The present invention is directed to a process for making manganese or manganese dioxide comprising the steps of:

(a) leaching a source of manganomanganic oxide ($Mn_3O_4$) with a sulfuric acid solution and a reducing agent, said reducing agent being present in an amount effective to reduce said manganomanganic oxide to manganese oxide (MnO), and said sulfuric acid being present in an amount effective to lower the pH to 3 or below and convert said manganese oxide to manganese sulfate;

(b) removing iron from said leach solution by adding a base to said leach solution to raise the pH of said leach solution to about 4 to 7, adding an oxidizing agent to said leach solution to form an iron precipitate, and filtering said iron precipitate and leach residues from said leach solution;

(c) removing heavy metals from said leach solution by adding a sulfide to said leach solution to form heavy metal precipitates, and filtering said heavy metal precipitates from said leach solution;

(d) treating said leach solution in an electrolytic cell having an anode and a cathode to deposit manganese metal on said cathode or manganese dioxide on said anode; and (e) recovering said manganese metal from said cathode or manganese dioxide from the anode.

Suitable sources of manganomanganic oxide include MOR fume, sintered manganese ore and natural manganese ores with less than about 7% available oxygen. MOR fume is a by-product from a manganese oxygen refining operation. It is predominately $Mn_3O_4$ (93% by weight) with the remaining components being other metal oxides.

Suitable sources of natural manganese ores with less than about 7% available oxygen include Assoman ore from South Africa.

Sintering of manganese ore is performed to convert all of the lower oxides of manganese, e.g. $MnO_2$ and $Mn_2O_3$ to manganomanganic oxide ($Mn_3O_4$). As should be appreciated, this goes contrary to the conventional roasting step where the higher oxides of manganese are converted to manganese oxide (MnO). Sintering also forms agglomerates of the ore. These agglomerates are physically easier to handle than unsintered ore in furnace operations. Sintered manganese ore is readily available since it is sold for use in the smelting operation used to make ferromanganese and silicomanganese.

Any manganese ore can be used in order to make the sintered ore used in the present invention. Suitable sources of ore include Groot Eyland Ore, Comilog Ore, and Brazilian Ore.

It is known that, if manganese ore is unsintered and subjected to a sulfuric acid solution leach with sulfur dioxide as a reducing agent, the sulfate balance is virtually impossible to maintain.

The sintering operation is conducted in a conventional manner using conventional equipment. The sintering operation should be conducted so as to convert at least 90% or more of the manganese in the ore to manganomanganic oxide.

The size of the agglomerates produced after the sintering operation is typically larger than 100 mesh (seive opening of 149 microns). In order to decrease the amount of time necessary for the leach step, it is preferred that the agglomerate be ground to a size of 200 mesh (seive opening of 74 microns) or below. It has been found that a sintered manganese ore having a mesh size of 100 takes about one day to leach while a mesh size of 200 takes about one to two hours to leach. It is presumed that the smaller the size the faster the rate of leach. However, to grind the sintered manganese ore below 200 is economically unnecessary.

The grinding operation is conducted in a conventional manner using conventional equipment.

The leach step is conducted using a sulfuric acid solution in an amount effective to lower the pH of the leach solution containing the source of manganomanganic oxide and reducing agent to about 3 or below. More preferably, the amount of the sulfuric acid is effective to lower the pH to about 1.5 initially. Theoretically, any acid can be used in the leach step, e.g. hydrochloric acid, however, sulfuric acid is readily available and used commercially.

Suitable reducing agents for use in the present invention include sulfur dioxide ($SO_2$), carbon, hydrogen peroxide ($H_2O_2$), a reducing sugar, molasses and compounds of the general formula $C_n(H_2O)_m$ where n and m are between 1 and 12.

Sulfur dioxide is readily available and is a preferred reducing agent for use in the present invention. The amount of sulfur dioxide added to the leach solution is based on the stoichiometric amount necessary to reduce manganomanganic oxide to manganese oxide (MnO). It has been found that no excess over the stoichiometric amount of sulfur dioxide is necessary for use in the leach solution. The stoichiometric amount of sulfur dioxide is based on the following equation:

$$Mn_3O_4+SO_2+2H_2SO_4 \rightarrow 3MnSO_4+2H_2O$$

When using sulfur dioxide as a reducing agent the temperature of the leach solution during the leach step is about 50° C. and the time for the leaching is about two (2) hours. The reaction between the manganomanganic oxide and the sulfur dioxide is exothermic so that no heat need be added to the reaction.

Other preferred reducing agents for use in the present invention is molasses, reducing sugar and activated carbon. The amount of molasses used in the present invention is preferably about 20% by weight, more than the calculated stoichiometric amount. Molasses is the by-product of extracting sucrose from sugar cane and generally contains reducing sugars along with other organic components. The stoichiometric amount of molasses is based on the following equation:

$$36H_2SO_4+C_6H_{10}O_5+12Mn_3O_4 \rightarrow 6CO_2+36MnSO_4+41H_2O$$

When using activated carbon, a reducing sugar or molasses, the temperature of the leach solution should be raised to between about 80 to about 90° C. The elevated temperature has been found to help promote the reduction of the manganomanganic oxide to manganese oxide.

The leaching step is conducted in a conventional manner using conventional equipment. Good results have been obtained using a tank equipped with an impeller to mix the various components used in the leach step. Generally, no heat is added to the leach solution and due to the exothermic nature of the reaction the leach solution is at a temperature of about 50° C. when sulfur dioxide ($SO_2$) is used as the reducing agent.

The next step in the process of the present invention is to raise the pH of the leach solution to about 4 to 7 and, more preferably, about 6 to 7, by the addition of a base and the addition of an oxidizing agent to convert the iron from the ferrous state to the ferric state thereby causing the iron to precipitate. Any base and any oxidizing agent can be used, however, the preferred bases are ammonium gas ($NH_3$) and/or lime and the preferred oxidizing agents are manganese oxide, or ores, or air. The ammonium gas and air are suitably bubbled into the tank.

The step of adjusting the pH and adding an oxidizing agent are accomplished in a conventional manner using conventional equipment.

Removing the precipitated iron is done in a conventional manner using conventional equipment. Typically, the iron precipitate is removed by filtration.

Next, a sulfide is added to precipitate the heavy metal. Suitable sulfides include ammonium sulfide, alkali metal sulfide and hydrogen sulfide. Ammonium sulfide is preferred. The heavy metals which are precipitated in this step typically include nickel, cobalt, arsenic, copper, zinc, lead, and molybdenum. The addition of the sulfide converts these heavy metals to sulfides which are precipitated in the solution.

The addition of the sulfide to the solution is accomplished in a conventional manner using conventional equipment.

Next, the precipitated heavy metals are then removed from the solution. The removal of the precipitated heavy metal sulfides is accomplished in a conventional manner using conventional equipment. Typically, the precipitated heavy metal sulfides are removed by filtration.

The removal of the heavy metals from solution preferably leaves less than about 1 ppm of heavy metal in solution.

The leach solution is then added to an electrolytic cell which has both cathodes and anodes. An electrical potential is applied to the anode and cathode which causes manganese metal to plate on the cathode. This step is accomplished in a conventional manner using conventional equipment.

Finally, the manganese metal is removed from the cathode in a conventional manner using conventional equipment. Typically, the manganese metal is in flakes and has a purity of about 99.5% by weight and above.

These and other aspects of the present invention may be more readily understood by reference to the following examples.

EXAMPLE 1

This example illustrates using sintered manganese ore and a reducing agent of $SO_2$ gas to make manganese.

Into a 380 liter tank equipped with an agitator, 316 liters of an aqueous anolyte (sulfuric acid leach solution) was added. The anolyte comprised:

| | |
|---|---|
| $H_2SO_4$ | 34 g/l |
| $MnSO_4$ | 30 g/l |
| $(NH_4)_2SO_4$ | 113 g/l |
| K | 4 g/l |

To the anolyte, 13.4 Kg of a sintered ore was added. The sintered ore had the following characteristics:

| | Percent by Weight |
|---|---|
| Mn | 52 |
| $SiO_2$ | 9 |
| $Al_2O_3$ | 4 |
| Fe | 6 |
| Mesh Size | 200 |

Initially, the temperature of the slurry was 50° C. and the pH was approximately 1.5. Over the next 3 hours, 2.5 Kg of $SO_2$ gas was bubbled through the tank as the reducing agent. The pH stayed at 3 or below throughout the step.

After 3 hours, finely ground manganese ore was added to the leach slurry to oxidize all $Fe^{2+}$ to $Fe^{3+}$. Then ammonium gas ($NH_3$) was added to raise the pH to about 5 and form an iron precipitate.

The slurry was filtered. Then 284 ml of ammonium sulfide was added to the filtrate to form heavy metal precipitates and it was filtered again.

Ammonium sulfide was added again to form heavy metal precipitates and the filtrate was filtered again to remove the heavy metal precipitates from the filtrate.

The necessary $SO_2$ was added to the filtrate and the filtrate was added to a manganese electrowinning cell. The current efficiency was 62.7% and manganese was recovered from the cathode.

EXAMPLE 2

This example illustrates using MOR fume and a reducing agent of $SO_2$ gas to make manganese.

Into the tank used in Example 1, above 323 liters of an aqueous based anolyte was added. The anolyte had the following composition:

| | |
|---|---|
| $H_2SO_4$ | 39 g/l |
| $MnSO_4$ | 36 g/l |
| $(NH_4)_2SO_4$ | 100 g/l |
| K | 6.5 g/l |
| Water | 1 |

To the anolyte was added 9.57 Kg of MOR fume having a composition:

| | Percent by Weight |
|---|---|
| Mn | 68 |
| $SiO_2$ | 0.05 |
| $Al_2O_3$ | 0.034 |
| Fe | 2.4 |

Initially, the temperature of the slurry was 47° C. and the pH was about 1.4. Over the next 2 hours $SO_2$ gas was bubbled through the leach solution as a reducing agent. Through the leaching step the pH of the slurry was at 3 or below.

To oxidize the iron and form an iron precipitate, 200 g of MOR fume and 1300 g of lime was added to the slurry.

To raise the pH of the slurry, ammonium gas ($NH_3$) was bubbled into the slurry. The slurry was then filtered to remove the iron precipitates.

Next, the slurry was treated with 582 ml of ammonium sulfide to form heavy metal precipitates and the slurry was filtered.

Finally, the necessary $SO_2$ was added to the filtrate and the filtrate was transferred to a manganese electrowinning cell. The average current efficiency was 61.6% and manganese was recovered from the cathode.

EXAMPLE 3

This example illustrates using a sintered ore and a reducing sugar as the reducing agent to make manganese.

Employing 12 g of sintered ore as used in Example 1 above along with 250 ml of the anolyte of Example 1 above, the leach step was carried out in a 250 ml flask with agitation. The flask was heated to maintain the temperature during the leach step at 70° C. A reducing sugar was added to slurry in an amount of 2 grams. The reducing sugar was the common household sugar (sucrose). The pH was maintained at 2 by adding acid and the leaching lasted 6.5 hours at a temperature of 70° C.

After the leach step, it was determined that the manganese concentration in the leach slurry was 35 g/l and that all the manganese in the ore had been dissolved in the anolyte and formed manganese sulfate.

The anolyte can be further processed in accordance with Example 1 to recover the manganese metal.

EXAMPLE 4

This example illustrates using sintered ore with molasses as a reducing agent to make manganese.

Using the equipment of Example 3 above, into the 250 ml flask was added: 250 ml of anolyte (as per Example 1); 12 g sintered ore (as per Example 1 except it had a mesh size of 325); and 0.7 g of molasses.

The temperature of the contents of the flask was maintained at 98° C. for 6 hours while acid was added as necessary to maintain the pH at 1.

After the leach step, the solution can be further processed in accordance with Example 1 to recover the manganese.

EXAMPLE 5

This example illustrates using sintered ore with activated carbon as a reducing agent to make manganese.

Using the equipment of Example 3 above, into the 250 ml flask was added: 250 ml of anolyte (as per Example 1); 12 g sintered ore (as per Example 1 except it had a mesh size of 200); and 4 g of activated carbon (120 mesh).

The temperature of the contents of the flask was maintained at 95° C. for 2.1 hours while acid was added as necessary to maintain the pH at 2.

After this period, 2.1 hours, it was determined that 80% of the manganese in the ore had been dissolved in the anolyte as manganese sulfate.

After completion of the leach step, the anolyte can be further processed in accordance with Example 1 to recover the manganese.

EXAMPLE 6

This example illustrates using Assoman Ore (an ore with less than about 7% available oxygen), and a reducing agent of $SO_2$ gas to make manganese.

Into an appropriate beaker having agitation, 10 liters of an anolyte having an approximate composition as in Example 1 was added along with 416 g of ore. The ore was from South Africa and was produced by Associated Manganese of South Africa. The ore had the following composition:

| | Percent by Weight |
|---|---|
| Mn | 50 |
| $SiO_2$ | 5 |
| $Al_2O_3$ | 1 |
| Ca | 3 |
| Available oxygen | 7 |
| Fe | 12 |

The solution was heated to 60° C. and $SO_2$ gas was bubbled through as a reducing agent to form manganese sulfate.

When most of the manganese had been dissolved from the ore, the anolyte was further processed in accordance with Example 2 to produce manganese. The current efficiency was about,70% during ½ hour plating time.

I claim:

1. A process for making manganese metal or manganese dioxide comprising the steps of:

(a) leaching a source of manganomanganic oxide with a sulfuric acid solution and a reducing agent, said reducing agent being present in an amount effective to reduce said manganomanganic oxide to manganese oxide and said sulfuric acid being present in an amount effective to lower the pH to 3 or below and convert the manganese oxide to manganese sulfate;

(b) adding a base to said leach solution to raise the pH of said leach solution to about 4 to 7;

(c) adding an oxidizing agent to said leach solution to form an iron precipitate;

(d) removing said iron precipitate from said leach solution;

(e) adding a sulfide to said leach solution to form heavy metal precipitates;

(f) removing said heavy metal precipitates from said leach solution;

(g) treating said leach solution in an electrolytic cell having an anode and a cathode to deposit manganese metal on said cathode or manganese dioxide on said anode; and (h) recovering said manganese metal from said cathode or manganese dioxide on said anode.

2. The process of claim 1 wherein prior to step (a), the process further comprises the steps of:

sintering a manganese ore to convert oxides of manganese in said ore to manganomanganic oxides and to agglomerate said ore; and grinding said agglomerates of ore to a mesh size of 100 mesh or below for use in the leaching step as said source of manganomanganic oxide.

3. The process of claim 2 wherein the reducing agent is selected from the group consisting of sulfur dioxide, activated carbon, reducing sugars and molasses, and any compound with general formula of $C_n(H_2O)_m$ where m and n are between 1 and 12.

4. The process of claim 3 wherein the pH of the leach solution is about 1.5 or below.

5. The process of claim 2 wherein the pH of the leach solution is about 1.5 or below.

6. The process of claim 1 wherein the pH of the leach solution is about 1.5 or below.

7. The process of claim 1 wherein the source of manganomanganic oxide is selected from the group consisting of sintered manganese ore, manganese ore having less than 7% available oxygen, and manganese oxygen refining (MOR) fume.

8. The process of claim 7 wherein the reducing agent is selected from the group consisting of sulfur dioxide, activated carbon, reducing sugars and molasses, and any compound with a general formula of $C_n(H_2O)_m$ where m and n are between 1 and 12.

9. The process of claim 8 wherein the pH of the leach solution is about 1.5 or below.

10. The process of claim 1 wherein the reducing agent is selected from the group consisting of sulfur dioxide, activated carbon, reducing sugars and molasses, and any compound with general formula of $C_n(H_2O)_m$ where m and n are between 1 and 12.

11. An electrolytic process for making manganese metal or manganese dioxide comprising the steps of:

(a) leaching in a sulfuric acid leach solution a source of manganomanganic oxide and a reducing agent wherein the reducing agent is present in an amount effective to reduce the manganomanganic oxide to manganese oxide and said sulfuric acid is present in an amount effective to lower the pH to 3 or below and convert the manganese oxide to manganese sulfate;

(b) purifying said leach solution to remove impurities from said leach solution; and (c) recovering manganese metal or manganese dioxide from said purified leach solution by means of an electrolytic cell.

12. The process of claim 11 wherein the source of manganomanganic oxide is selected from the group consisting of sintered manganese ore, manganese ore having less than 7% available oxygen, and manganese oxygen refining (MOR) fume.

13. The process of claim 12 wherein the reducing agent is selected from the group consisting of sulfur dioxide, activated carbon, reducing sugars and molasses, and any compound with general formula of $C_n(H_2O)_m$ where m and n are between 1 and 12.

14. The process of claim 11 wherein the reducing agent is selected from the group consisting of sulfur dioxide, activated carbon, reducing sugars and molasses, and any compound with general formula of $C_n(H_2O)_m$ where m and n are between 1 and 12.

* * * * *